US010934144B2

(12) United States Patent
Dissing

(10) Patent No.: US 10,934,144 B2
(45) Date of Patent: Mar. 2, 2021

(54) AUXILIARY MOUNTING TOOL FOR THE POSITIONING OF ELEMENTS IN RELATION TO AN ADJACENT FLAT OR PLANE

(71) Applicant: Dissing A/S, Skanderborg (DK)

(72) Inventor: Claus Hornstrup Dissing, Ry (DK)

(73) Assignee: Dissing A/S, Skanderborg (DK)

( * ) Notice: Subject to any disclaimer, the term of this patent is extended or adjusted under 35 U.S.C. 154(b) by 126 days.

(21) Appl. No.: 15/109,153

(22) PCT Filed: Aug. 6, 2015

(86) PCT No.: PCT/DK2015/050231
§ 371 (c)(1),
(2) Date: Jun. 30, 2016

(87) PCT Pub. No.: WO2016/019965
PCT Pub. Date: Feb. 11, 2016

(65) Prior Publication Data

US 2016/0325971 A1 Nov. 10, 2016

(30) Foreign Application Priority Data

Aug. 8, 2014 (DK) ..... PA 2014 70478

(51) Int. Cl.
*B66F 3/35* (2006.01)
*E04F 21/00* (2006.01)

(52) U.S. Cl.
CPC ..... *B66F 3/35* (2013.01); *E04F 21/0015* (2013.01)

(58) Field of Classification Search
CPC . B66F 3/35; B66F 3/247; B66F 11/04; A61G 7/1021; A63G 31/12;
(Continued)

(56) References Cited

U.S. PATENT DOCUMENTS 4,275,869 A 6/1981 Clements
4,697,290 A * 10/1987 Alklind ..... A61G 7/001 5/632
(Continued)

FOREIGN PATENT DOCUMENTS

CA 2479521 A1 * 11/2005 ..... E02B 3/064
CN 201106358 Y 8/2008
(Continued)

*Primary Examiner* — Lee D Wilson
*Assistant Examiner* — Joel D Crandall
(74) *Attorney, Agent, or Firm* — James Creighton Wray

(57) ABSTRACT

An auxiliary tool to be employed when positioning elements, such as window and door frames is described, in relation to an adjacent flat or plane, such as within wall openings, whereby the auxiliary tool comprises an inflatable air cushion member (6) which through a hose connection means (10) is connected to a pumping device (12) and a bleeding valve (16). The air cushion member is shaped as a flat bag unit. The auxiliary tool furthermore comprises connecting elements (42, 46, 48) for the mutual fixation of an air cushion member (6) comprising one or more adjacent air cushion members which have two or more mutually fixed air cushion members (6) which selectively are inflatable. These are in a side by side relationship provided positioned in a common plane so that in total the flat bag unit sides form opposing sides within the auxiliary tool.

5 Claims, 20 Drawing Sheets

(58) Field of Classification Search
CPC ..... B29L 2022/025; B29L 2022/02; B29L 2022/027; E04F 21/0015
USPC ..... 254/93 HP
See application file for complete search history.

(56) References Cited

U.S. PATENT DOCUMENTS

| | | | | |
|---|---|---|---|---|
| 5,142,720 | A * | 9/1992 | Kelso | A61G 7/001 5/630 |
| 6,298,539 | B1 * | 10/2001 | Dissing | E05B 19/20 254/93 HP |
| 8,215,615 | B2 * | 7/2012 | Niklasson | F15B 15/10 254/93 HP |
| 2004/0217338 | A1 * | 11/2004 | Abrahamson | B66F 3/35 254/93 H |
| 2006/0260210 | A1 | 11/2006 | Tanielian | |
| 2013/0291801 | A1 * | 11/2013 | Throndsen | A01K 29/00 119/28.5 |
| 2014/0373283 | A1 * | 12/2014 | Lange | E05D 3/00 5/722 |

FOREIGN PATENT DOCUMENTS

| | | | |
|---|---|---|---|
| CN | 201826443 | U | 5/2011 |
| CN | 203562152 | U | 4/2014 |
| CN | 204169480 | U | 2/2015 |
| DE | 2113056 | A1 | 9/1972 |
| DE | 3022936 | A1 | 12/1981 |
| DE | 29800344 | U1 | 5/1998 |
| DE | 29717506 | U1 | 1/1999 |
| DK | 177510 | B1 | 8/2013 |
| EP | 0771385 | A1 | 5/1997 |
| EP | 1788180 | A2 | 5/2007 |
| FR | 2414021 | A1 | 8/1979 |
| JP | 3026155 | U | 7/1996 |
| WO | 8502648 | A1 | 6/1985 |
| WO | 9513448 | A1 | 5/1995 |
| WO | 9853167 | A1 | 11/1998 |
| WO | 9915741 | A1 | 4/1999 |
| WO | 2004000507 | A1 | 12/2003 |
| WO | 2004031522 | A1 | 4/2004 |
| WO | 2011017589 | A1 | 2/2011 |

* cited by examiner

AUXILIARY MOUNTING TOOL FOR THE POSITIONING OF ELEMENTS IN RELATION TO AN ADJACENT FLAT OR PLANE

This application claims the benefit of Danish Application No. PA 2014 70478 filed Aug. 8, 2014, and PCT/DK2015/050231 filed Aug. 6, 2015, International Publication No. WO 2016/019965 A1, which are hereby incorporated by reference in their entirety as if fully set forth herein.

The present invention relates to an auxiliary tool to be employed when positioning elements, such as window and door frames in relation to an adjacent flat or plane, such as within wall openings, whereby the auxiliary tool comprises an inflatable air cushion member made of a strong and flexible respectively bendable, but substantially unstretchable material, which through a hose member is connected to an inflating device as well as a bleeding valve, and whereby the air cushion member is a flat bag unit, which exhibits mutually opposingly arranged flat bag sides, whereby the flat bag sides are composed of layers of the mentioned material placed face to face and being joined along their free edges to form reinforced double layer edges.

Such an auxiliary tool is known from EP 0 771 385. Through which an auxiliary tool is described as intended to be used while mounting frame elements into to these elements adapted wall openings in buildings. Thus, this will typically relate to the positioning of window and door frames into wall openings, where the individual frames need to be placed in a certain relation to the slightly larger wall opening. Earlier it was common practice as the introductory mounting procedure step to keep the frames in place in wall openings by means of wedges. By means of the auxiliary tool according to EP 0 771 385 a less complicated mounting procedure is achieved enabling the carrying out of this to be done by just one single person.

Thus, while employing selectively inflatable air cushion members which become inserted into the space between individual frames and the corresponding wall opening in such a manner that the position of the particular individual frame in the wall opening easily can be accurately adjusted to acquire the wanted accurate position in that the air cushion members being present at this mentioned one side of the wall opening thus become inflated more or less in respect to the pressure which simultaneously is being excerted through the other oppositely arranged flat bag units, so enabling a single person to easily position the frame precisely.

It is decisive, that the air cushion members "only" are purely flat bag units, because they then can be influenced to a controlled displacing of them in a single direction and thus simultaneously making it possible that the frame through a moderate air bag pressure is enabled to be displaced in other directions in order to achieve a final correct adjustment when the final fixation is taking place.

The flat bag units are able by means of a small activating force to exert a rather large pressure towards the external surfaces of the individual frames, of among other reasons the best solution may be to provide the flat bag units arranged somewhat close to the upper, respectively the lower, part of the individual frames. And besides, by employing an increased amount of flat bag units a straightening of possibly externally bulging sideportions of individual frames may furthermore be obtained.

It is very important that the flat bag units are embodied in such a manner that they are stable against any rolling movement, i.e. corresponding to the type of rolling which a rubber hose is able to perform, which has attained a "flat oval shaped" cross section by the application of a sidewardsly exerted pressure, and whereby in such case the flat bag units will not be able to carry the individual frames by means of the frictional pressure which is exerted against the side surfaces of the vertical oriented gaps being present between the individual frames and the receiving opening in the wall.

Such a kind of stabilizing can on the other hand easily be achieved preferably in such a way that the cushion members are being embodied in shape of a double layer of a strong and flexible, but substantially unstretchable, material, i.e. such as armoured plastic foil, whereby flat edges of this material are being joined at one or more of the side edge areas of the unit. The best and the most simple possibility is that the cushion member is provided by folding a single rectangular piece of the foil material including a subsequent welding together of the protruding three free edge areas, while at the folded edge area a required connecting hose is connected to the inflating ball and the included bleeding valve, because this is in practice made possible in that the folding edge is not required to exhibit a sharp bend folding.

Despite the fact that the cushion members belonging to the state of the art provide great advantages at the positioning of members in relation to an adjacent flat, the force which they are able to exert is limited due to the employed material. Furthermore, the auxiliary tool exhibits one single point of load and due hereto only does provide one point of attack which can be employed to provide straightening respective displacing.

Whenever it is wanted to provide a larger force more cushion members have to be employed. On the other hand, these may then mutually undergo displacements in relation to each other so that the wanted support does not appear at the spot, where it is wanted. This can make it difficult to achieve a correct support and levelling of the element which is supported.

For many years an auxiliary tool providing a larger force has been wanted and which furthermore provides a stable support and provides the possibility for an adjusting of the force at different points of attack.

The present invention has the purpose to describe an auxiliary tool which makes use of the advantages associated with the flat bag units belonging to the state of the art and whereby the aforementioned drawbacks are avoided so that it becomes possible to achieve a stable support comprising possibility for an adjustment of the force at different points of attack.

According to the invention this is achieved by means of an auxiliary tool of the type according to the above mentioned ingress and is characterized in that the auxiliary tool further comprises a connecting element to the mutual fixation of an air cushion member comprising one or more adjacent air cushion members for the providing of an auxiliary tool comprising two or more mutually fixated air cushion members which selectively are inflatable and which are placed in a side by side relationship in a common plane so that the sides of the flat bag unit together provide opposing sides within the auxiliary tool.

According to the present invention it is thus possible to employ a desired number of beside each other arranged air cushion members which together form a stable support as they mutually in position are being kept fixed by means of the connecting elements. The air cushion members in relation to the other air cushion members thus can't be "displaced" away from their positions and the positions of each of the air cushion members in relation to the element being supported are furthermore also stabilized.

Thus a multipoint configured load comprising a number of load carrying points which correspond to the number of employed air cushion members is achieved. I.e. it is possible to operate by means of a stepless adjustment of force thus covering a larger area and making it possible to adjust respectively to press upon or to move the supported element. In this manner the auxiliary tool may also be employed together with elements which are not homogeneous or do not exhibit any homogeneous form and elements which to be brought upright in place at specific places do require extra force to the carrying out of this operation.

Though the invention primarily is based upon the employing of inflation to provide different pressures within the different air cushion members it is also possible to provide inflation which provide the same pressure in all or only in a part of the air cushion members comprised in an auxiliary tool.

The air cushion members of the auxiliary tool may in principle be identical to the air cushion members which are described in EP 0 771 385, the contents of which through this reference hereby are included. Those members may in certain cases be employed unaltered in shape or a modification of the double layer edges may be required in that they become provided with interconnecting means which can establish the cooperation with the corresponding interconnecting means belonging to the element of connection.

It is possible to provide an assembly of air cushion members which it is possible to handle as one single unit. This facilitates the handling in that only one operator is required even when very heavy and inhomogeneous elements are to be put in place, and whereby large forces and a varied amount of influencing forces are required due to either the kind of structure or the shape of the elements or due to varying demands to alignments or levellings of the elements.

The invention incorporates the great advantage that the air cushion members exert a very care taking influence on the elements, i.e. in that no kind of pressure markings are left over due to the preliminary use of the intermediate fixation means.

Furthermore, the employing of a "battery" of air cushion members does create an enhanced safety level for the user. Even in case a single air cushion member should malfunction or puncture the remaining air cushion members will safeguard that the member is not pressed against the flat or surface in relation to which flat or surface it is being placed respectively is put in position to, i.e. accordingly any risk of a squeezing pressure is reduced or is fully prevented thus also thereby including any risk of damaging of the element or of the flat which serves as support.

According to a further embodiment the container according to the invention is characterized in that the air cushion member comprises protruding edge flanges which at least one corner comprises a hole or opening, and that the connecting element comprises at least one pin member for engaging the mentioned at least one hole or opening. The holes may alternatively be positioned at a long-side instead of at a corner. The hole may furthermore serve as a bore, through which pins for temporary fixation of the air cushion member to the external surface of the flat belonging to the element can be inserted.

According to a further embodiment the container according to the invention is characterized in that the connecting element is comprised of a substantially flat frame structure comprising frame side units which are provided with openings within which the air cushion members become arranged, so that these at least are protruding out over just one of the side surfaces belonging to the frame structure. A frame structure provides a simple way of providing a "grid" for the receiving of the air cushion members within the fields thus being provided by means of the frame side units.

The frame may be of rectangular shape or of other polygonal shapes, i.e. as of hexagonal shape. Or, the shape could be manufactured as curved, as by way of example circular or oval shapes.

The frame may in principle exhibit a thickness which corresponds to the thickness of the non inflatable air cushion members, whereby the auxiliary tool may be insertable into the same narrow chinks or slots as those into which a single air cushion member may be inserted.

The container according to the invention may exhibit a further embodiment which is characterized in that the frame structure is shaped comprising a number of frame portions comprising connecting members which cooperate to connect the frame portions to a coherent frame structure. According hereto it in a simple way is made possible to provide a frame which exhibits a wanted size and shape.

The container according to the invention may exhibit a further embodiment which is characterized in that the connecting members are releasable connecting members, preferably cooperating pin members and recesses along side edges of the frame portions. By employing frame portions together with releasable connecting members then after being used these frame portions may be segregated and thereupon are ready to be reused and i.e. for the forming of a new configuration.

The container according to the invention may exhibit a further embodiment which is characterized in that the frame, as according to choice, is a frame manufactured with flexible frame side portions so that the frame structure is made to be resilient after the inflation of the air cushion members or it is manufactured with stiff frame side portions and flexible edge flanges so that the edge flanges are made able to give way after the inflation of the air cushion members.

The frame side portions may be manufactured of a stiff material which preserves a stable shape after the inflation by means of the air cushion members. This may be achieved in that within the interconnecting members between air cushion members and the frame structure a possibility for providing a flexibility has to be present which is able to compensate for the contraction of the side edges of the air cushion member which contraction is present during the inflation or otherwise the edge flanges may have to be resilient. Or, as an alternative the frame side portions may be resilient so these are pulled during the inflation.

The container according to the invention may exhibit a further embodiment which is characterized in that the connecting member is manufactured of a coherent tissue within which a number of pockets are provided whereby each pocket serves to occupy an air cushion member, and in that each pocket serves to the fixation of an air cushion member in relation to one or more adjacent air cushion members which are being positioned within one or more of the adjacent pockets, and which pockets may be provided as being arranged on one or on both sides of the tissue. Hereby it becomes possible to store the frame structure in roll shape on rolls and from which portions of tissue simply may be cut to fit a wanted configuration and wanted size as it may be required for the single tasks.

Within the present application the term tissue implies any material being lengthy or long stretched in shape. Thus, it does not need to be manufactured by weaving. It might also be an extruded lengthy or long stretched shaped material.

In case of employing a double layer tissue pockets are to be formed only at one side of the tissue for the mutual fixing of the air cushion members which in this manner become arranged as being mutually sidewardsly positioned within a common plane, i.e. together the flat bag unit sides are forming opposing sides within the auxiliary tool.

In case of employing a three-layer tissue it is possible to form pockets on both sides of the tissue. Such pockets are preferably positioned as two and two mutually arranged opposite each other, i.e. as opposing each other pairwise, so that the air cushion members become positioned while forming two layers. I.e. the pockets become "stacked" as two and two above each other. In this manner a larger working height is achieved as compared to employing air cushion members which are arranged as mutually sidewardsly positioned within a common plane. In this manner the flat bag unit sides together respectively being viewed as from one layer to the other mutually are providing opposing sides within the auxiliary tool.

The container according to the invention may exhibit a further embodiment which is characterized in that the tissue is manufactured with pockets whereby, as the pockets are provided with each an opening, these openings are facing in the same direction.

In certain situations it may be preferred that the pockets are provided with openings which are oriented in different directions to achieve a more easy access to the inflation device.

The container according to the invention may exhibit a further embodiment which is characterized in that the air cushion member is manufactured from a folded material layer.

The most simple possibility is that the air cushion member is manufactured by the folding of one singular rectangular shaped piece of foil material with subsequent welding together of the provided three free edge areas, and whereby a required connecting hose at the folded edge area is connected to the inflation device and the accompanying bleeding valve, whereby this possibility in practice can be carried out because no sharp bending of the folded edge is required.

The container according to the invention may exhibit a further embodiment which is characterized in that the length of the inflatable air cushion member exhibits the same order of size as the width of it, preferably abt. 15 cm and furthermore that the air cushion member is inflatable to achieve a thickness of up to 50 through 60 mm. Herethrough it becomes possible to operate the tool at slotwidths with sizes of up to 50 through 60 mm.

Below the invention is described in more detail under reference to the drawing within which:

DETAILED DESCRIPTION

Figure 1:
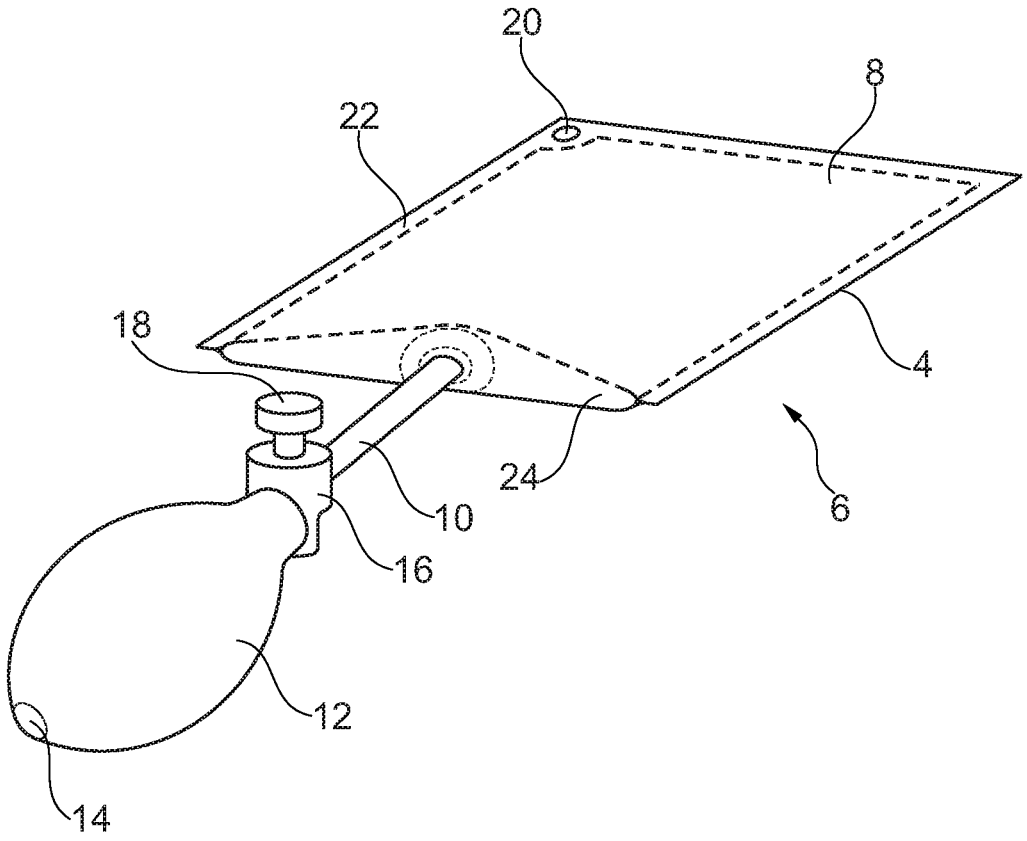
FIG. 1 illustrates in the perspective an air cushion member to be employed within the auxiliary tool according to the invention.

Within this more specifique portion of the present specification elements which either are identical elements or are corresponding elements carrying the same signs of reference. And no repeated descriptive explanation is given below for each single element within the different figures which belong to the drawing.

The air cushion member 6 shown in FIG. 1 does through EP 1 0771 385 belong to the state of the art.

In FIG. 1 it is shown that the air cushion member 6 can be manufactured by folding back and edge welding 4 of a rectangular shaped piece of a lengthy or long stretched material 8 which preferably should be easily bendable but substantially non-stretchable and preferably in shape of an armoured plastic foil. Before carrying out the folding to the inside of the folded material at 24 a foot piece is fastened comprising a protruding bendable stud or hose 10 for the establishing of a connection to an inflation ball 12 comprising an intake valve 14. In the connecting establishing means to the ball 12 or directly to the ball itself a bleeding valve 16 with a knob 18 for the activation of it is provided. At a corner portion of the flat leveled together welded edge 22' a hole 20 may be provided.

The stud or hose 10 may, optionally, protrude while forming an acute angle with the folding edge at 24, so that the ball 12 may be located as downwards pointing from the air cushion member.

Figure 2:
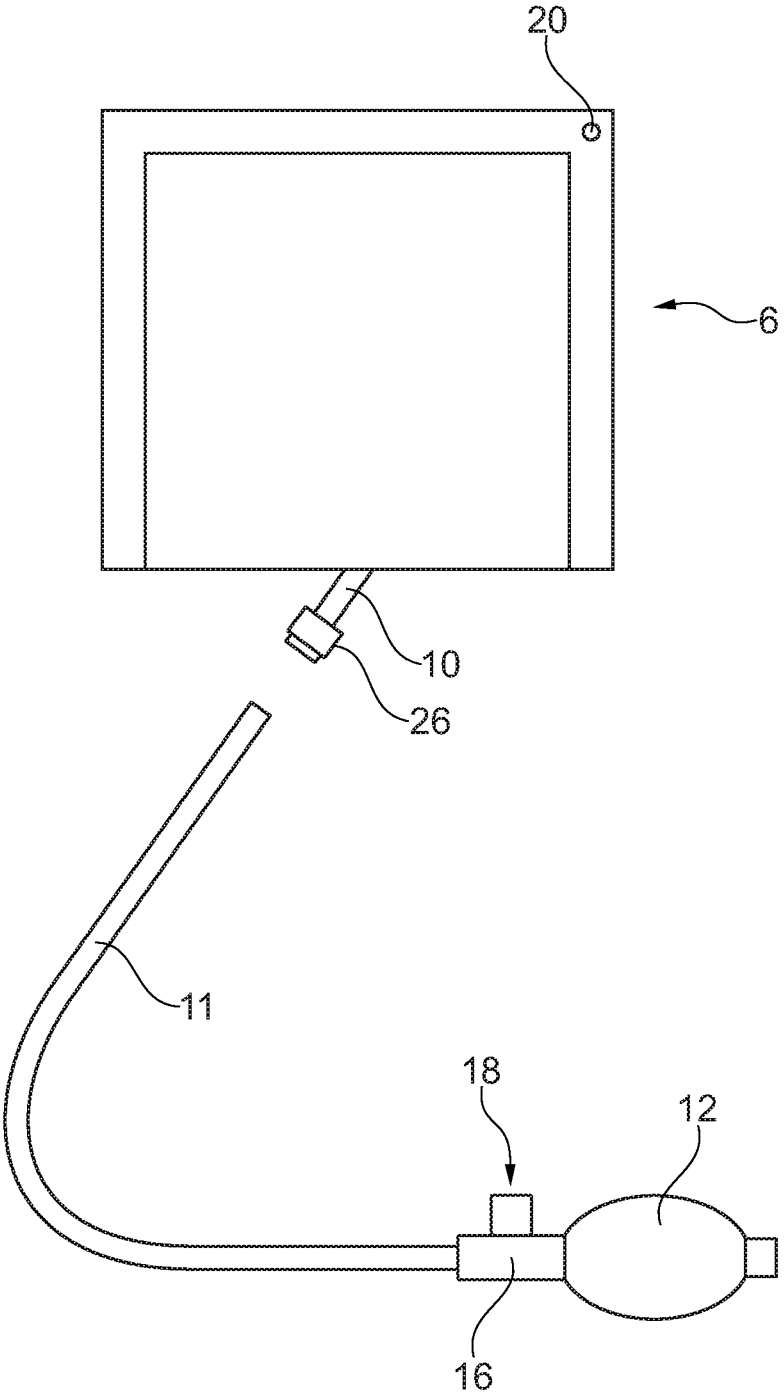
FIGS. 2-5 illustrate different embodiments of an air cushion member, a hose connection and a inflating device.

In FIG. 2 an air cushion member 6 is shown comprising a stud 10 to which a hose quick lock coupling element 26 is attached. Together with the ball 12 and the valve 16 a long hose 11 is provided. The hose may according to task be abbreviated.

Figure 3:
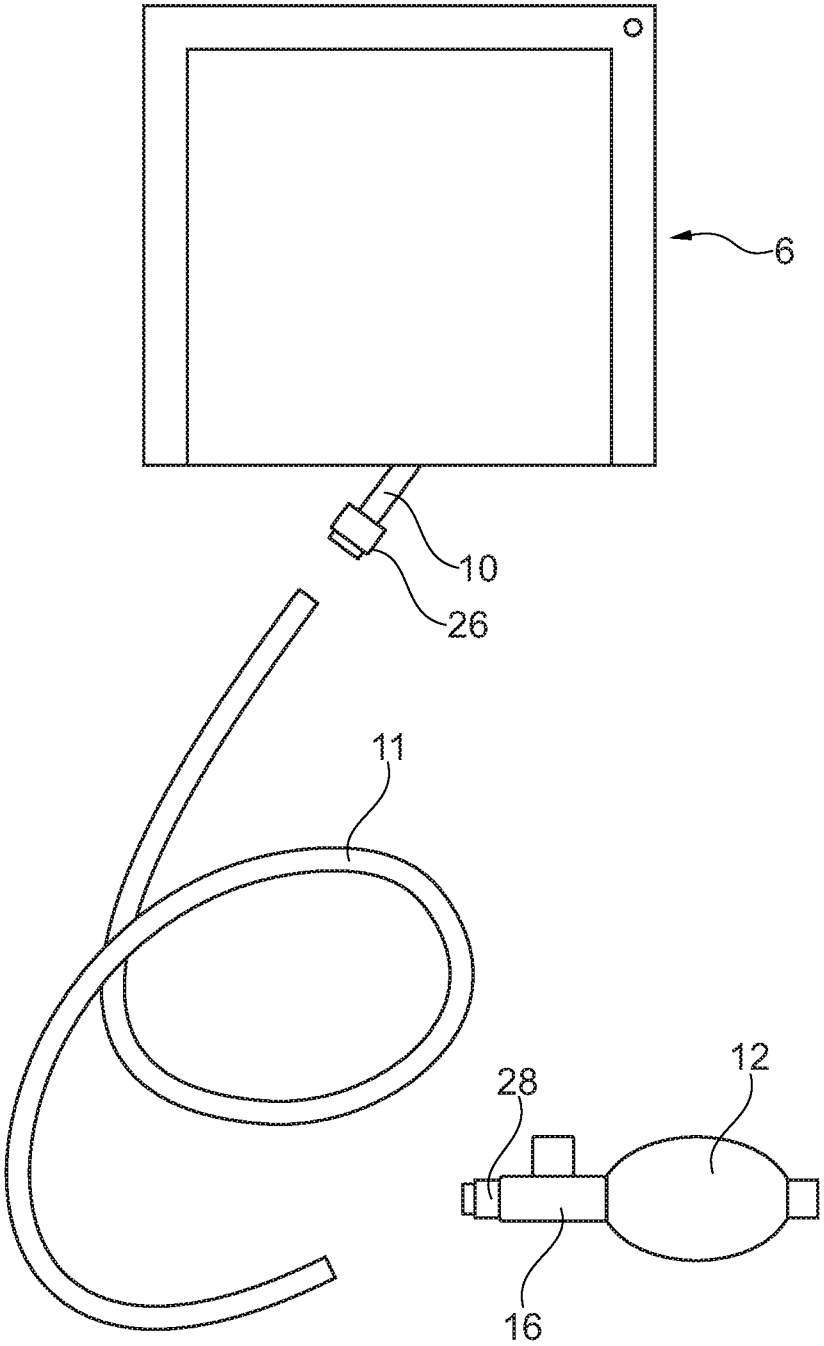

In FIG. 3 an embodiment is shown where in conjunction with the valve 16 a hose quick lock coupling element 28 is provided. Thus, the hose 11 is being provided as a loose element which according to task may be abbreviated.

Figure 4:
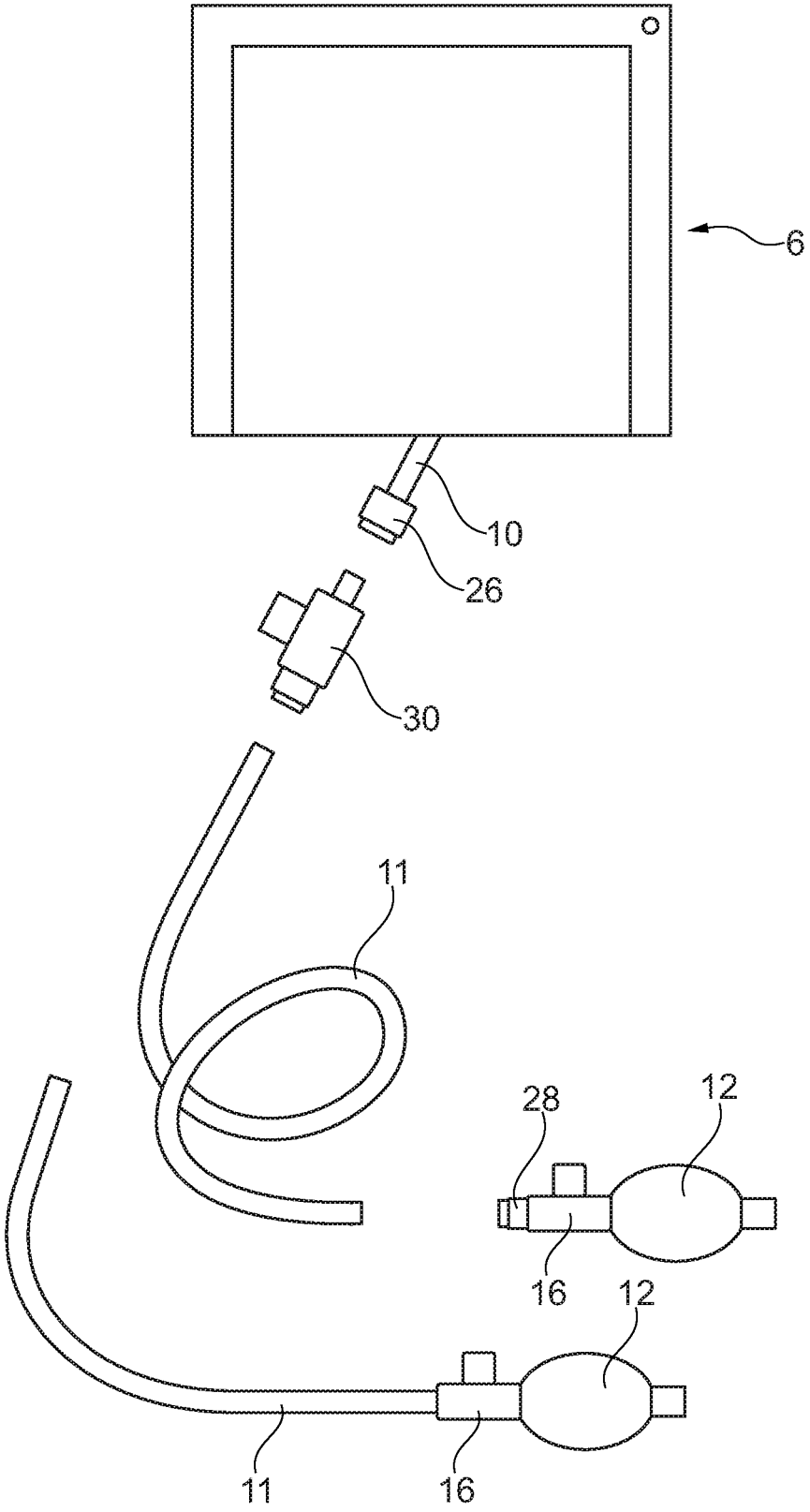

In FIG. 4 an embodiment is shown where a loose hose 11 may be connected by means of a hose quick lock coupling element 28 which is attached to the valve 16 or optionally a hose may be employed which fixed is attached to the valve 16. Between the hose 11 and the hose quick lock coupling element 26 on the air cushion member 6 a loos check valve 30 is provided which may be connected to the hose quick lock coupling element 26.

Figure 5:
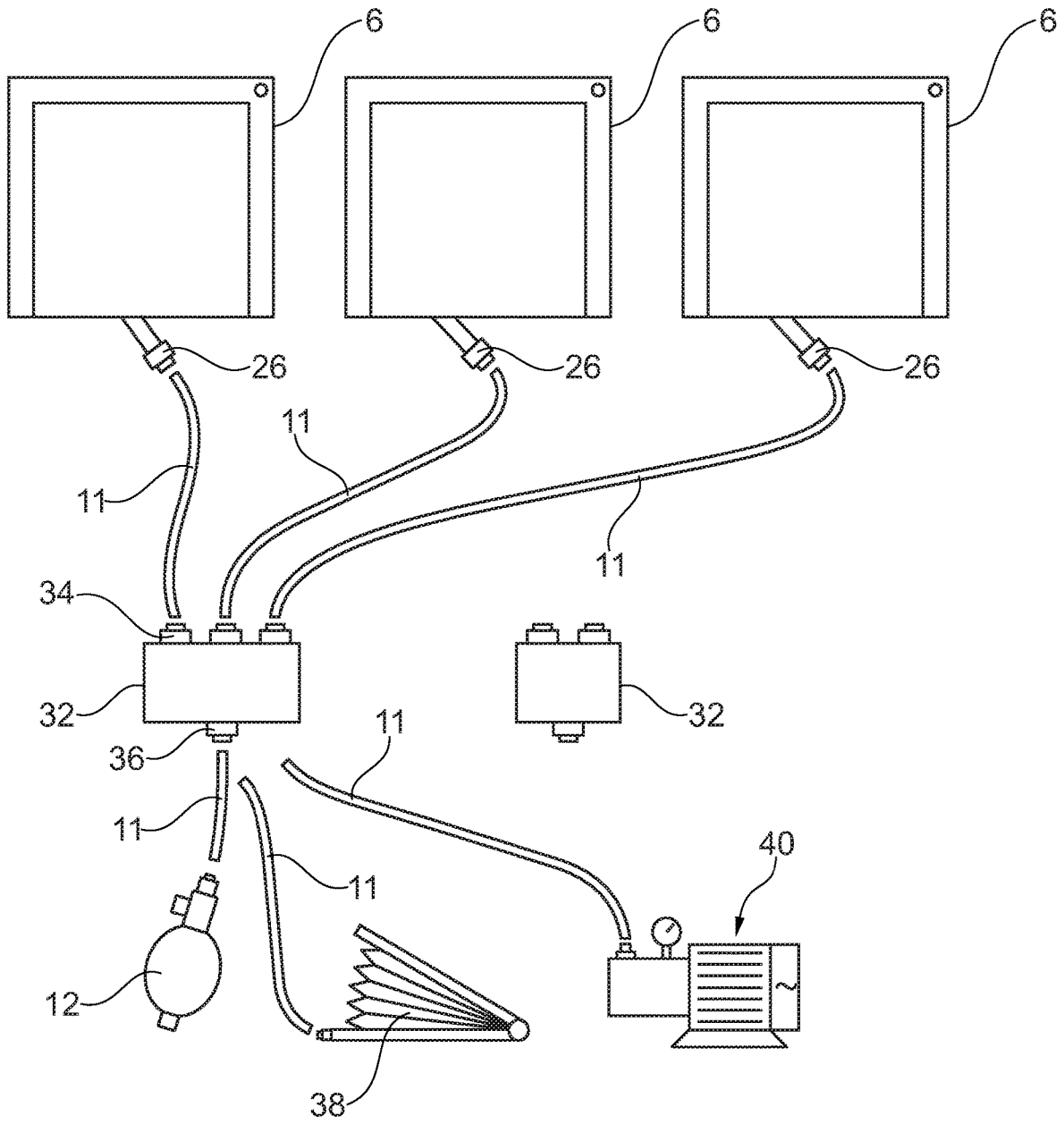

In FIG. 5 more air cushion members 6 are shown which through a manifold 32 may be connected to a pump. The manifold may be embodied as a 2:1 or a 3:1 or a 4:1 manifold. In the drawing manifolds 3:1 and 2:1 are illustrated.

The manifold 32 is provided with output studs 34 which may be provided with hose quick lock coupling elements. The manifold comprises furthermore a hose connecting stud 36 for the connection to hoses 11, which either can be connected to a ball 12, or to a foot pump 38 or to an electric driven air pump 40.

Figure 6:
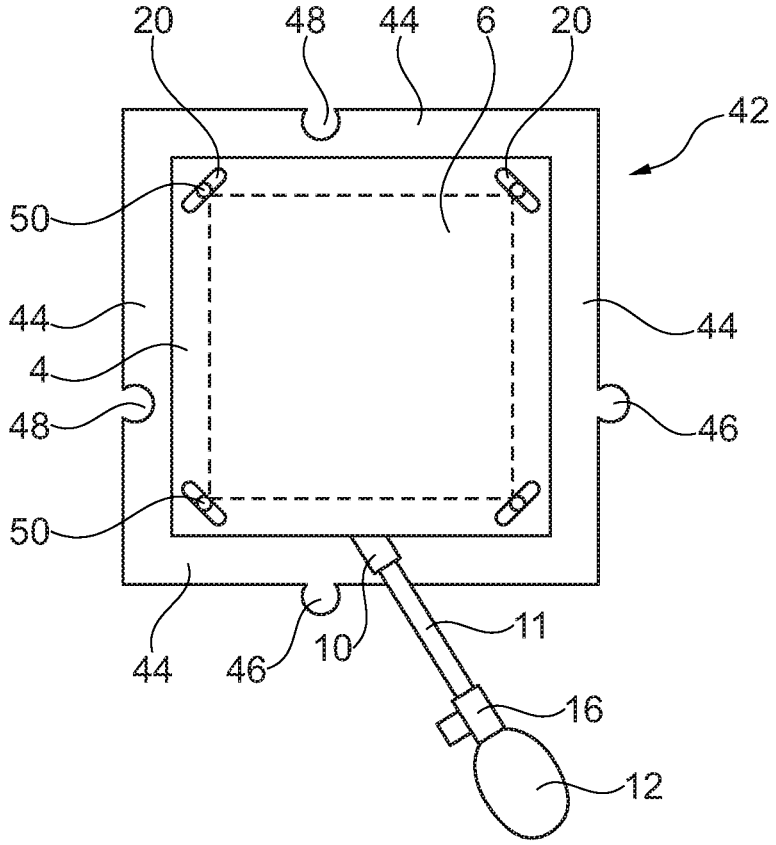
FIGS. 6-7 illustrate an embodiment according to the invention with a frame structure, in part as a single module element and in part as two together connected module elements.

In FIG. 6 a module element 42 for a frame structure is shown. The module element 42 comprises fixed frame sides 44 by which protruding portions 46 and recesses 48 are in such a manner provided so that adjacent module elements 42 may, as mounted together, be forming one single frame. Inside the frame the air cushion member 6' is present. In each corner of the flanges, being provided by means of the edge weldings 4, openings 20 are provided. The openings 20 cooperate with a pin means 50 which is fixed mounted in the frame module 42. In this manner the air cushion member 6 is being fixed to the frame module 42. The openings 50 may be round or oblong. Oblong openings provide the possibility that the structure may react resiliently.

Figure 7:
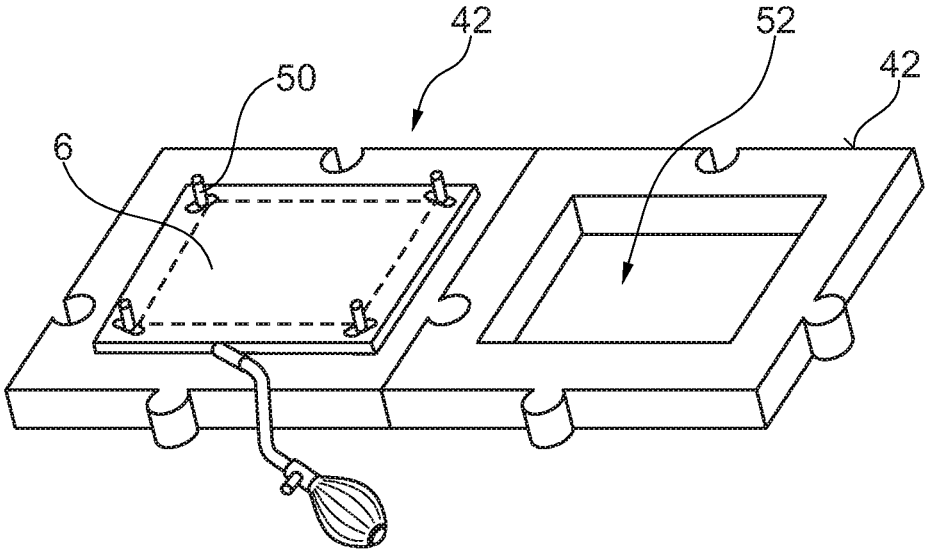

In FIG. 7 two adjacent frame modules are shown coupled together by means of the protruding portions 46 and the recesses 48. Thus, the frame module may provide a "grid" comprising a number of open cavities 52. The air cushion member 6 is positioned inside the open cavities 52.

In the embodiment which is shown the air cushion member 6 is arranged fixed at each corner. Alternatively this fixation may only be provided at one or two of the corners of the frame module.

The frame module 42 exhibits a flat structure of an open kind. When the air cushion member 6 is inflated by pumping it will thus protrude to either side viewed in relation to the flat frame.

Figure 8:
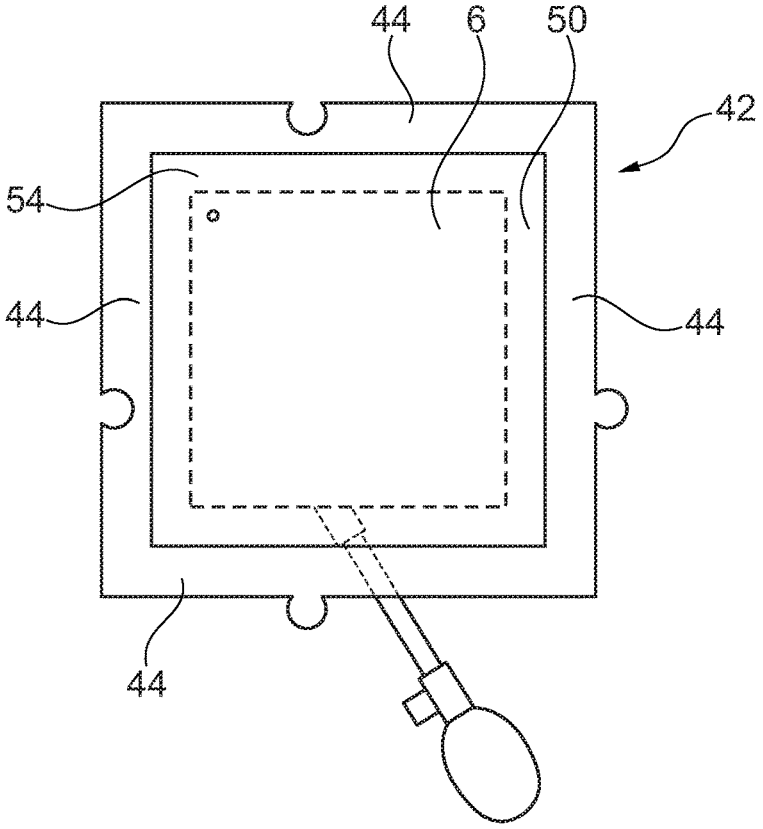
FIGS. 8-9 illustrate in plane view and in the perspective a further embodiment of a module element of an auxiliary tool according to the invention.
Figure 9:
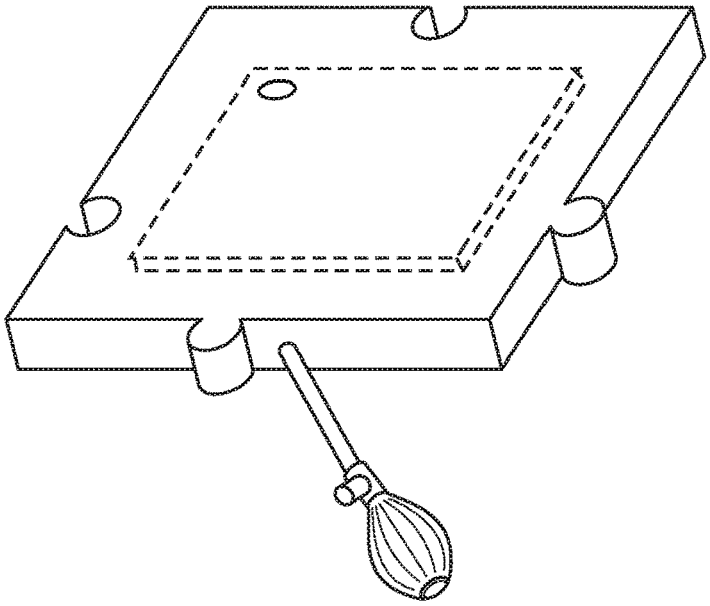

In FIG. 8 a fixed frame of closed shape is shown. The frame is being closed by means of a flexible thin material 54 at the over- and underside of the frame module 42. And the air cushion member may be positioned "loosely" within the open cavity 50 between the frame side portions 44.

Figure 10:
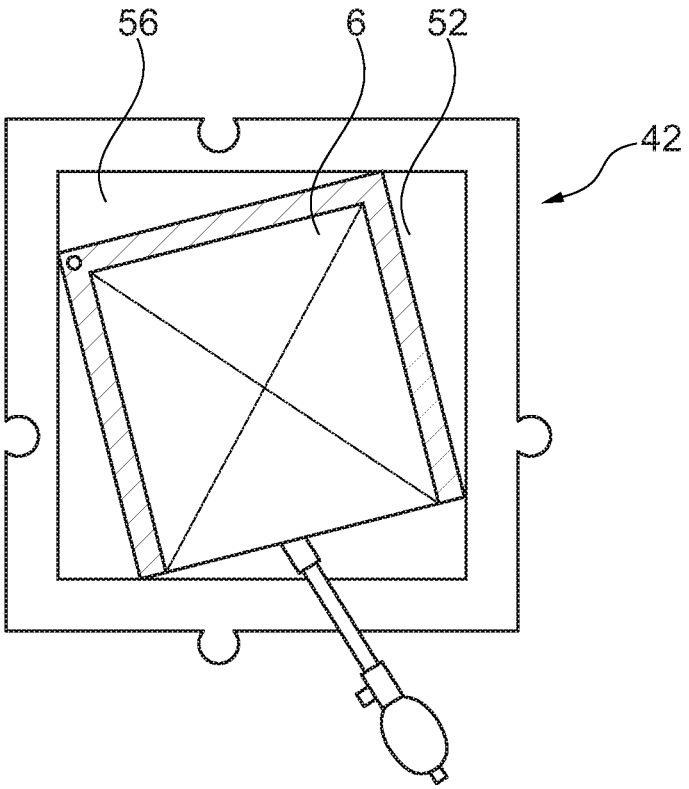
FIGS. 10-11 illustrate in plane view and in the perspective a further embodiment of a module element of an auxiliary tool according to the invention.

In FIG. 10 a frame module is shown which also is foreseen to form a fixed frame. The fixed frame is provided with a bottom 56 upon which the air cushion member 6 is resting. The air cushion member 6 may thus be put loosely in place as shown in FIG. 10. Alternatively the air cushion member may be fixed by means of a pin means 50 which cooperate with a hole at the corner of the air cushion member 6.

Figure 11:
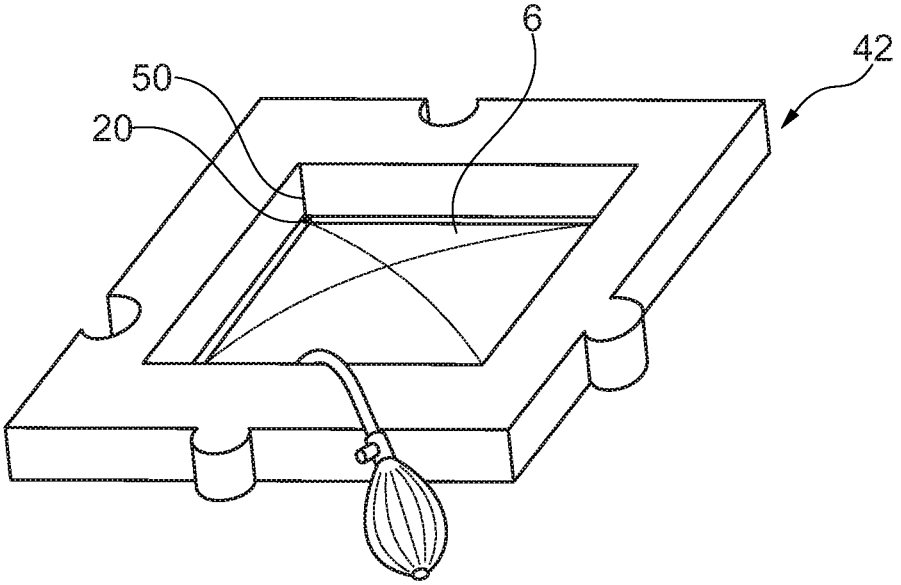

The frame modules which are shown in FIGS. 10 and 11 may, just as mentioned above, be coupled together to the forming of a fixed frame where a wanted number of air cushion members are positioned located in one plane.

Figure 12:
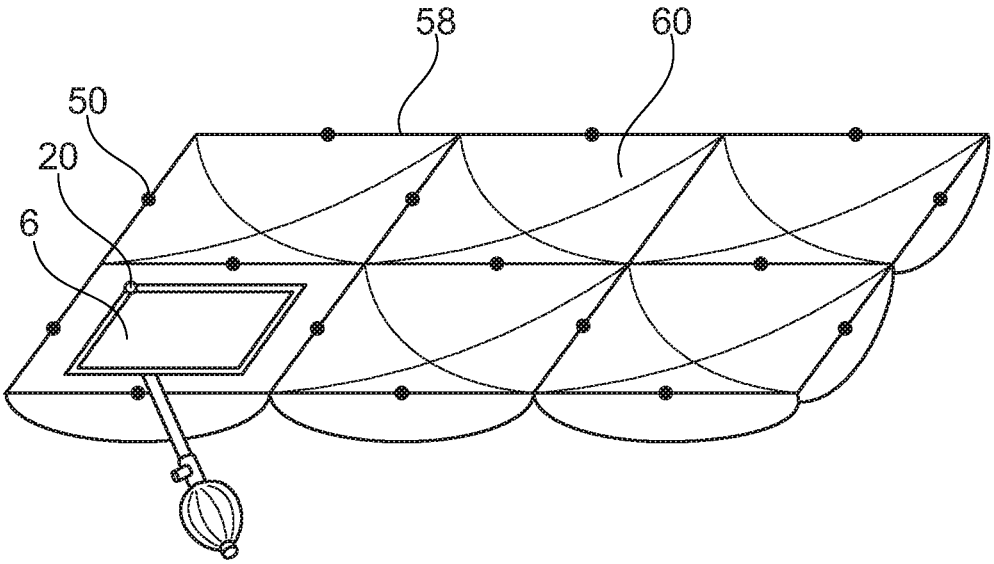
FIGS. 12-13 illustrate in the perspective and in cross section a further embodiment of an auxiliary tool according to the invention.
Figure 13:
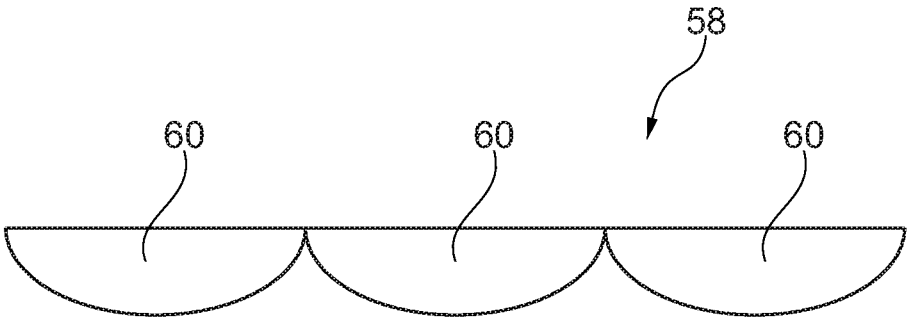

In FIGS. 12 and 13 an embodiment is shown where a frame 58 is shaped with a number of sidewardsly positioned depressions 60 for receiving an air cushion member 6. The air cushion member 6 may be positioned loosely in the frame 58 or may be fixed in place in that the opening 20 cooperates with pin means 50.

Figure 14:
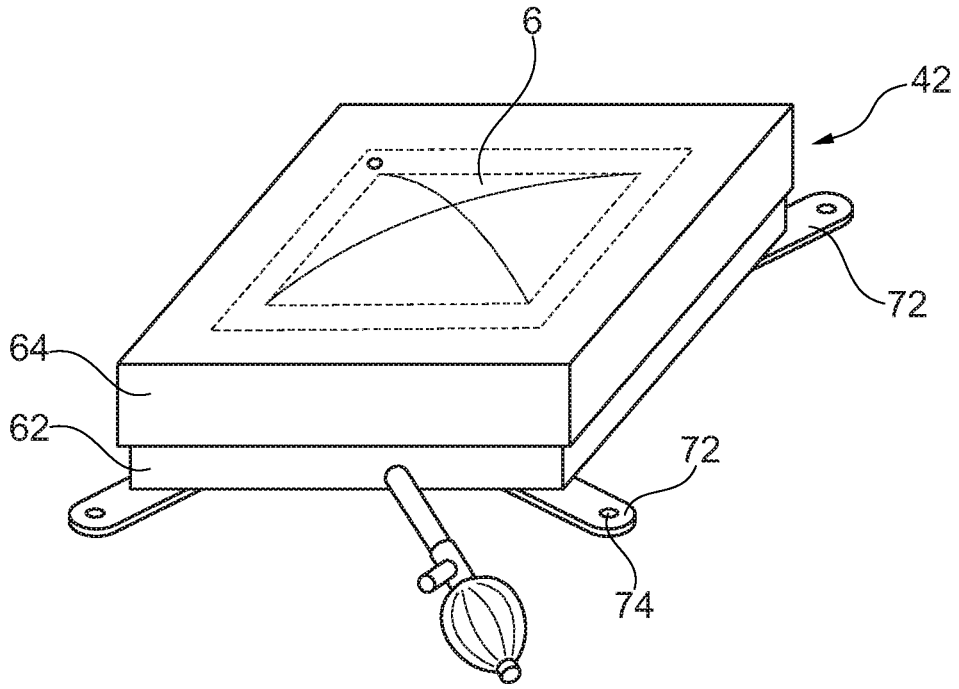
FIG. 14 illustrates in the perspective a further embodiment of a module element of an auxiliary tool according to the invention.

In FIG. 14 a further embodiment of a frame module 42 is shown. The frame module consists of a bottom portion 62 and a cover portion 64. The cover portion 64 can in telescopic manner be displaced downwards over the bottom portion 62. An air cushion member 6 is placed inside the thus shaped box and when pumped the bottom and the cover portions become displaced away from each other.

The material of the top portion may be stiff or flexible. The air cushion member 6 may be put loosely in position inside the shaped box.

Figure 15:
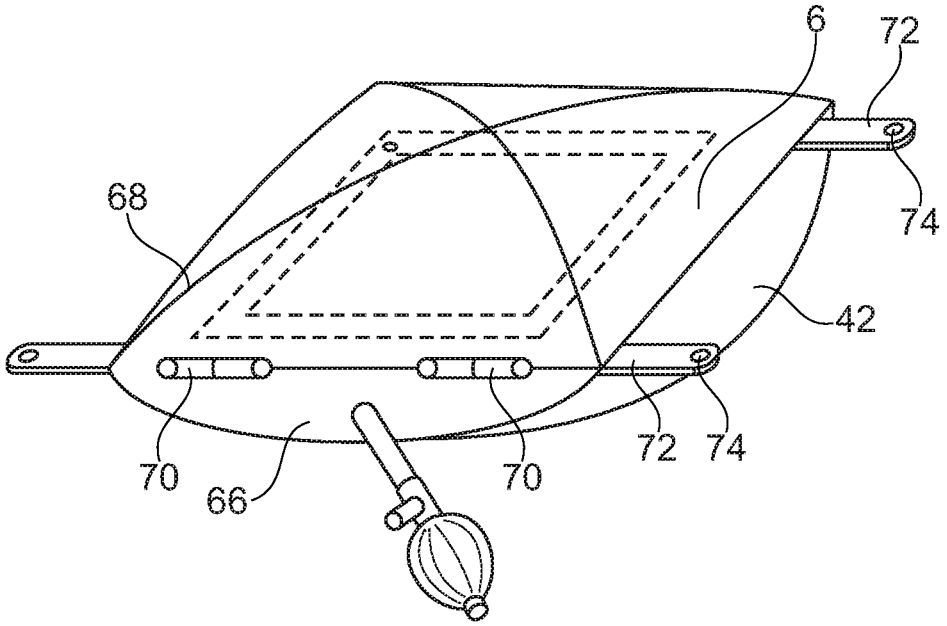
FIG. 15 illustrates a further embodiment of a module element of an auxiliary tool according to the invention.

In FIG. 15 a further embodiment of the frame module 42 is shown. Within this embodiment a bottom portion 66 and a top portion 68 are provided. These portions are by means of hinges 70 mutually connected able to perform a pivoting movement when inflating the air cushion member 6.

The frame modules 42 are provided with tongues or flaps 72 comprising an opening 74. By means of this arrangement a number of frame modules can be connected together by putting a pin member through the openings 74 thereby coupling sidewardsly adjacent frame modules together.

Figure 16:
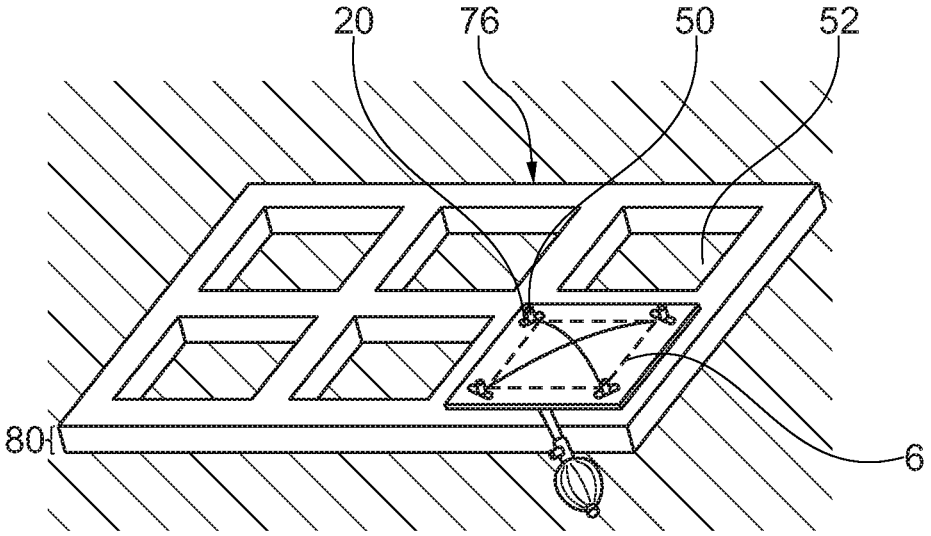
FIG. 16 illustrates in the perspective a further embodiment of an auxiliary tool according to the invention.
Figure 17:
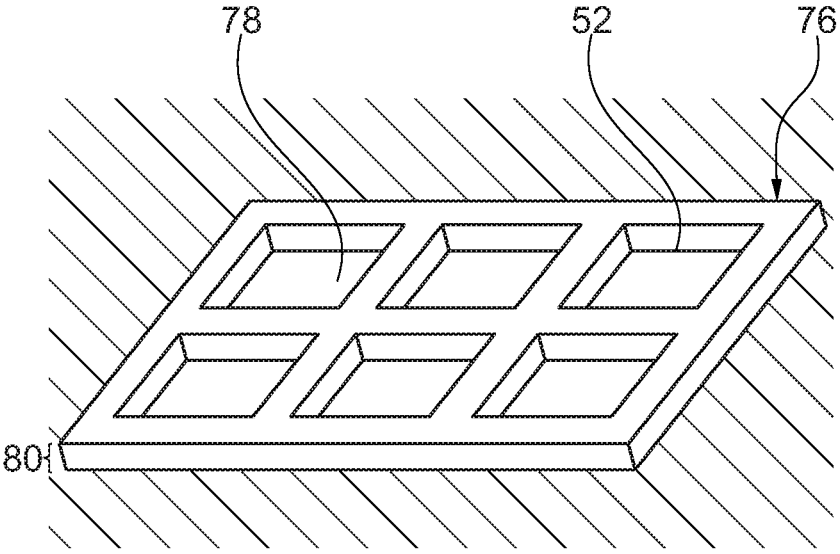
FIG. 17 illustrates in the perspective a further embodiment of an auxiliary tool according to the invention.

In FIGS. 16 and 17 a fixed frame is shown which provides more cavities 52 whereby each of these serve to receive an air cushion member 6 (only shown within FIG. 16).

The air cushion member 6 may be arranged at one or more of the corners of it through cooperation between an opening in the air cushion member 6 and a pin member 50 being connected with the frame 76.

In FIG. 16 the frame is shown being a frame which upwardsly and downwardsly is open. In FIG. 17 the frame is shown comprising cavities 52 which are only upwardsly open in that a bottom member 78 is provided within the openings 52.

Within both embodiments the frame is shaped so flat that an inflated air cushion member 6 will protrude above the frame. When the air cushion member 6 is in non-inflated condition it is able to be held in place within the frame so that the height 80 of the frame will be decisive for the interspace or slot into which the auxiliary tool can be inserted.

The height 80 may be adapted so that it approximately corresponds to the height of a non-inflated air cushion member 6.

The frame 76 may be manufactured of a stiff material or of a material which is flexible.

Figure 18:
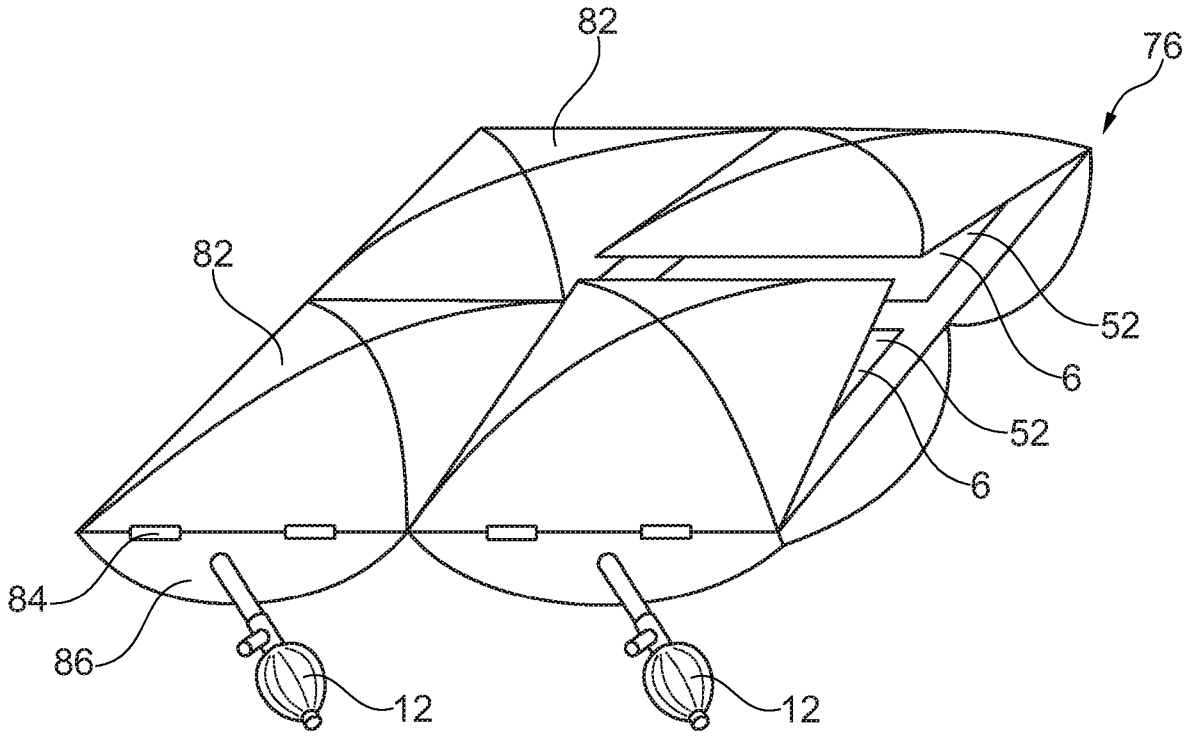
FIG. 18 illustrates in the perspective a further embodiment of an auxiliary tool according to the invention.

In FIG. 18 a frame 76 comprising more cavities 52 is shown whereby each of these cavities 52 serves to accommodate an air cushion member 6. Each of the cavities 52 is covered by an individually movable cover member 82 which by means of hinges 84 is connected to a bottom portion 86 of the frame 76. Through individual pumping of the air cushion members 6 the cover members 82 individually are upwards moved. Within the frame 76 the air cushion members 6 may be comprised in a loose manner.

Figure 19:
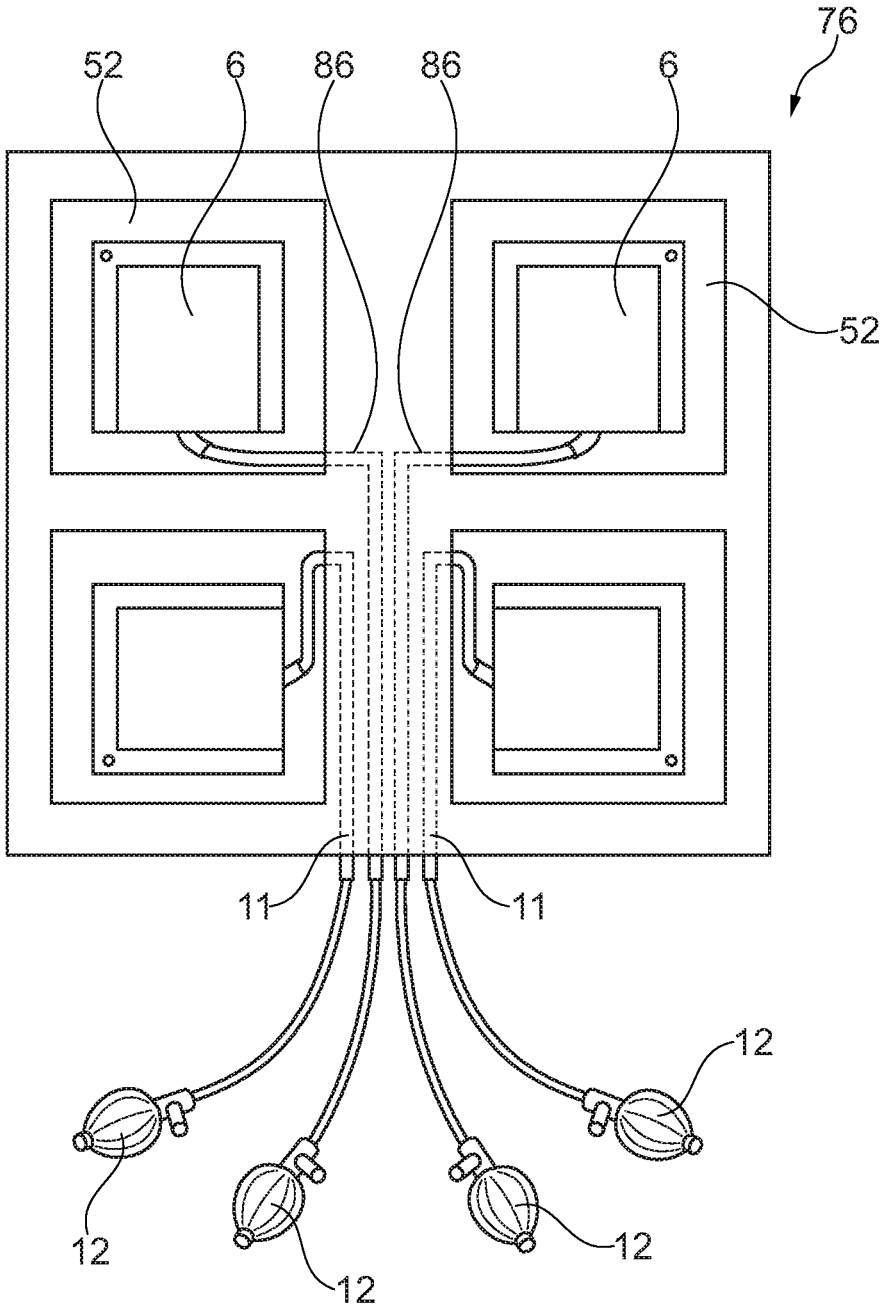
FIG. 19 illustrates in plane view a further embodiment of an auxiliary tool according to the invention.

In FIG. 19 an auxiliary tool according to the invention is shown comprising a frame 76 which includes four cavities 52 each of these comprising an air cushion member 6. The frame may be embodied as being open or closed as well at the top as at the bottom. Hereby the frame may be embodied as closed by means of flexible material or by means of a movable cover member or as only being provided with a bottom member thus leaving it open towards the opposite side.

The frame 76 comprises a depression within which a number of tubes 86 are provided in that each of them is leading forward for the connection of an air cushion member 6 each of these including an appropriately adapted kind of ball member 12. In this manner a possibility for pumping the air cushion members 6 within the frame 76 becomes provided.

It is possible to provide a marking, for instance by means of colour, to indicate which pumping providing ball member 12 does belong to which cavity within the frame 76.

Even though the frame is shown as comprising four cavities another number of cavities may be employed.

Figure 20:
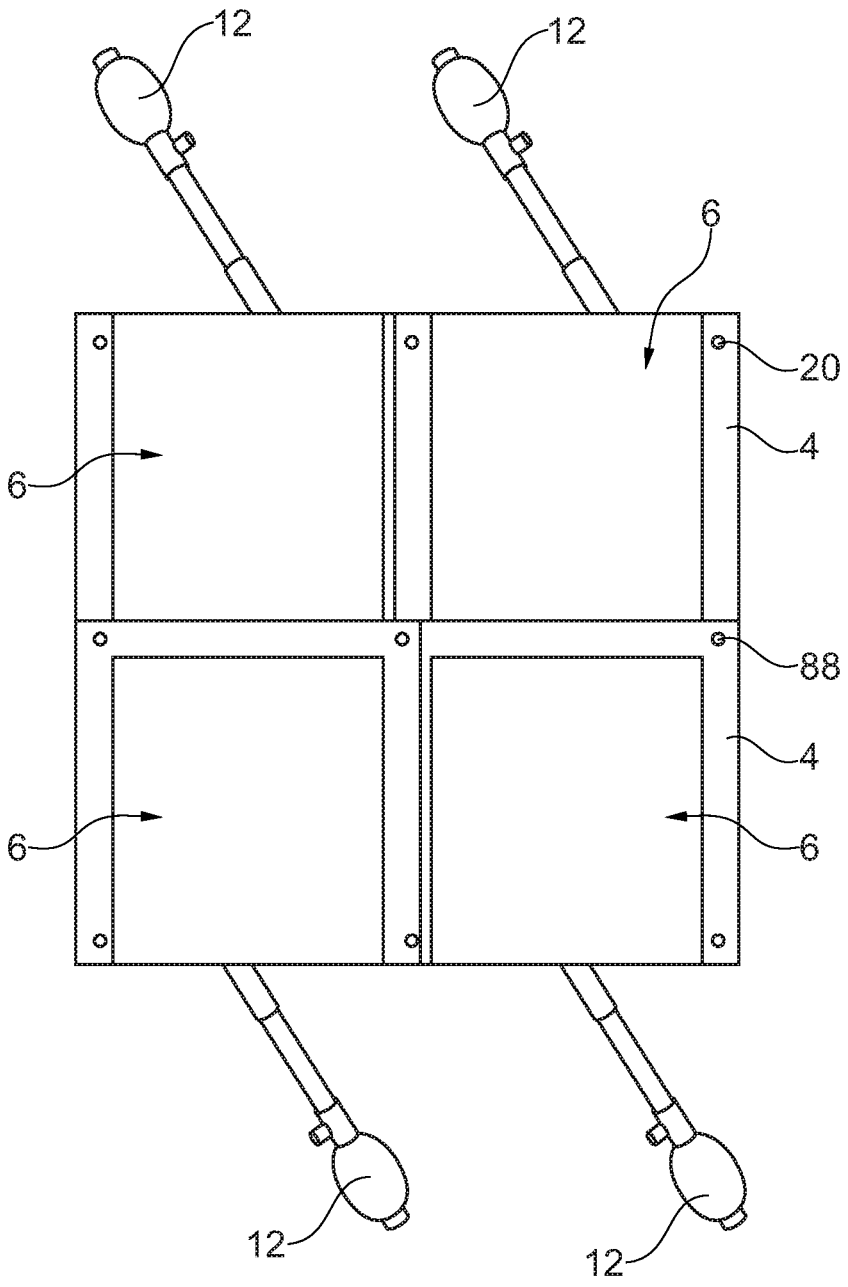
FIG. 20 illustrates in plane view a further embodiment of an auxiliary tool according to the invention.

In FIG. 20 an auxiliary tool according to the invention is shown where a number of air cushion members comprise openings 20 within the edge weldings 4. The openings 20 are furnished at each corner. Thereby it becomes possible for the coupling together of adjacent air cushion members 6 by means of pin members 88 or similar connecting means.

Thus the pin members 88 will provide a direct fixing in place of adjacent air cushion members by means of the grips through the incorporated openings 20 within the edge weldings 4.

Figure 21:
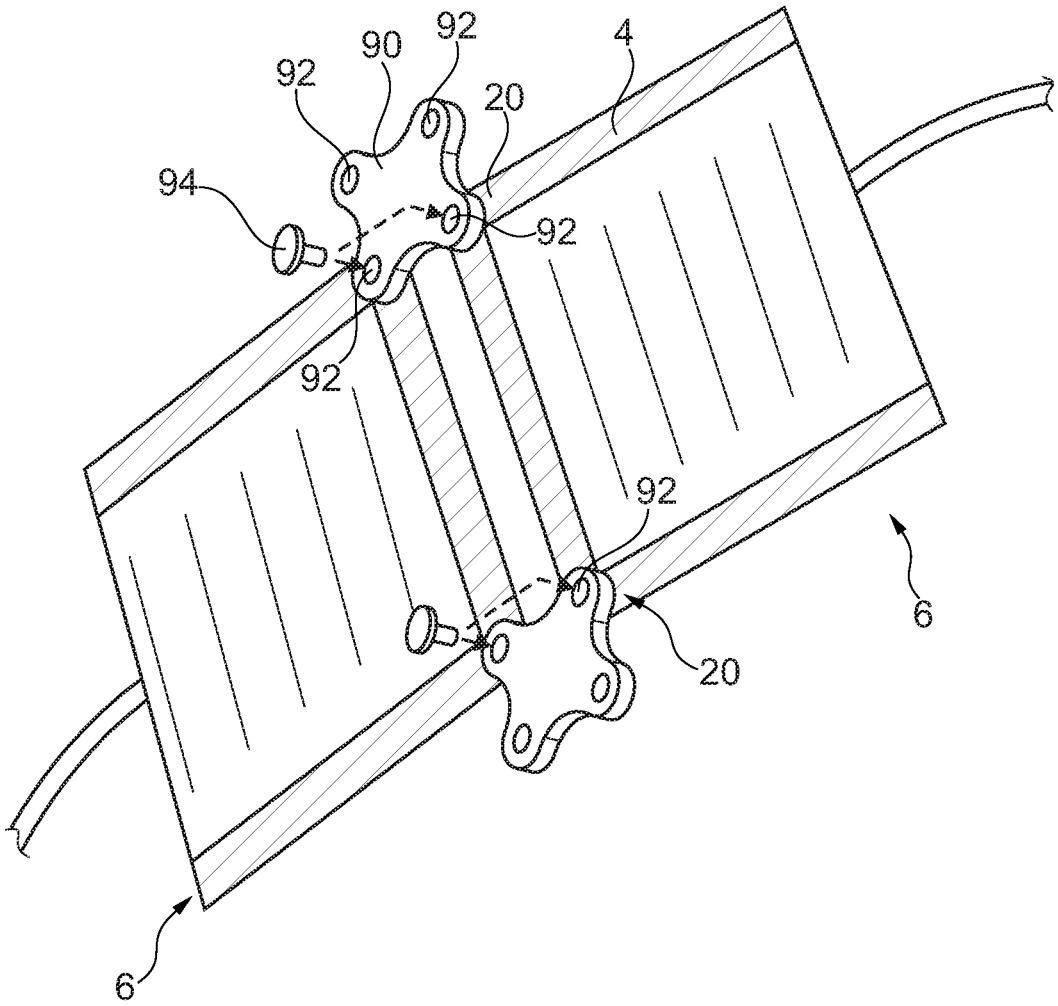
FIG. 21 illustrates in the perspective a further embodiment of an auxiliary tool according to the invention.

In FIG. 21 a further embodiment is shown by which the air cushion member 6 is mounted by means of fittings 90. These are substantially of rectangular shape within each corner comprising openings 92. The openings 92 may overlay the openings 20. Pins 94 are provided to connect the openings 92 of the connecting element 90 with openings 20 in the corners of the edge weldings 4 of the cushion members 6. In FIG. 21, two of the openings 92 of the connecting element 90 are used to connect two corners of two air cushion members 6. The two other openings 92 of the connecting element 90 can be used to connect to two additional corners of two air cushion members 6 for binding in total four air cushion members 6 together.

Figure 22:
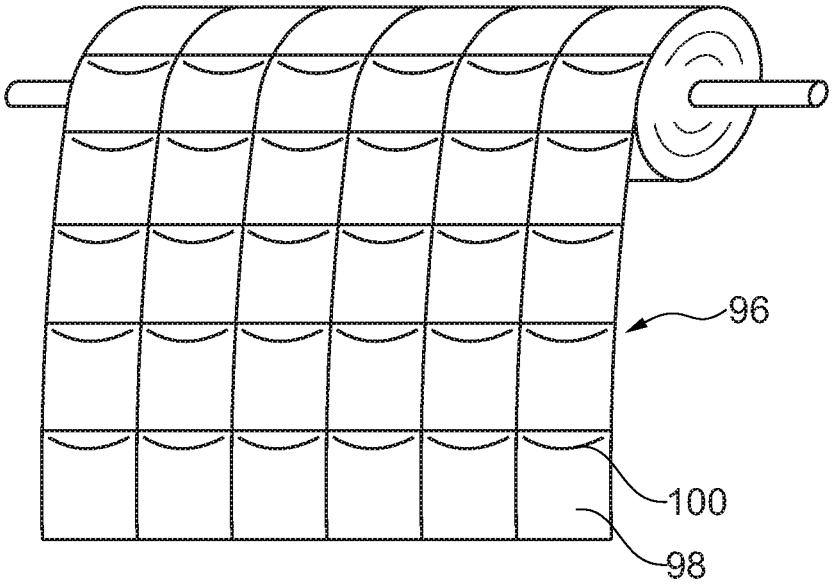
FIG. 22 illustrates in the perspective a tissue which is employed as frame structure within an auxiliary tool according to the invention.

In FIG. 22 a tissue 96 is shown which comprises a number of sidewards pockets 98 each comprising an opening 100 into which an air cushion member 6 may be inserted.

Figure 23:
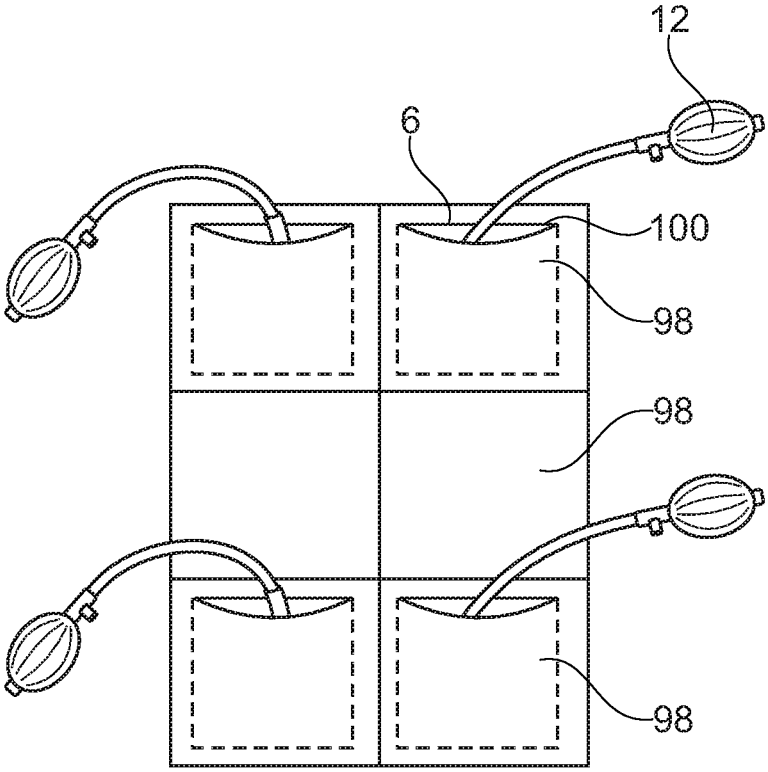
FIG. 23 illustrates a further embodiment of an auxiliary tool according to the invention, within which a frame structure according to FIG. 22 is employed.

The tissue 96 thus may be cut to provide suitable shaped patterns such as by way of example being shown in FIG. 23 where a total of six pockets 98 is achieved. Of air cushion members 6 only the positioning of four of these within the pockets 98 is shown in FIG. 23. On the other hand, it is also possible to place an air cushion member 6 into each pocket which is comprised within the cut-out tissue.

The tissue 96 may be manufactured as a three-layer-structure, implying, that a pocket will be located at the opposing side as viewed in relation to the illustrated pockets 98.

The tissue may be manufactured of a non-stretchable material at that one side which is connected with stretchable material for the forming of pockets to achieve that an expansion of the pocket is made possible when pumping the air cushion member.

Figure 24:
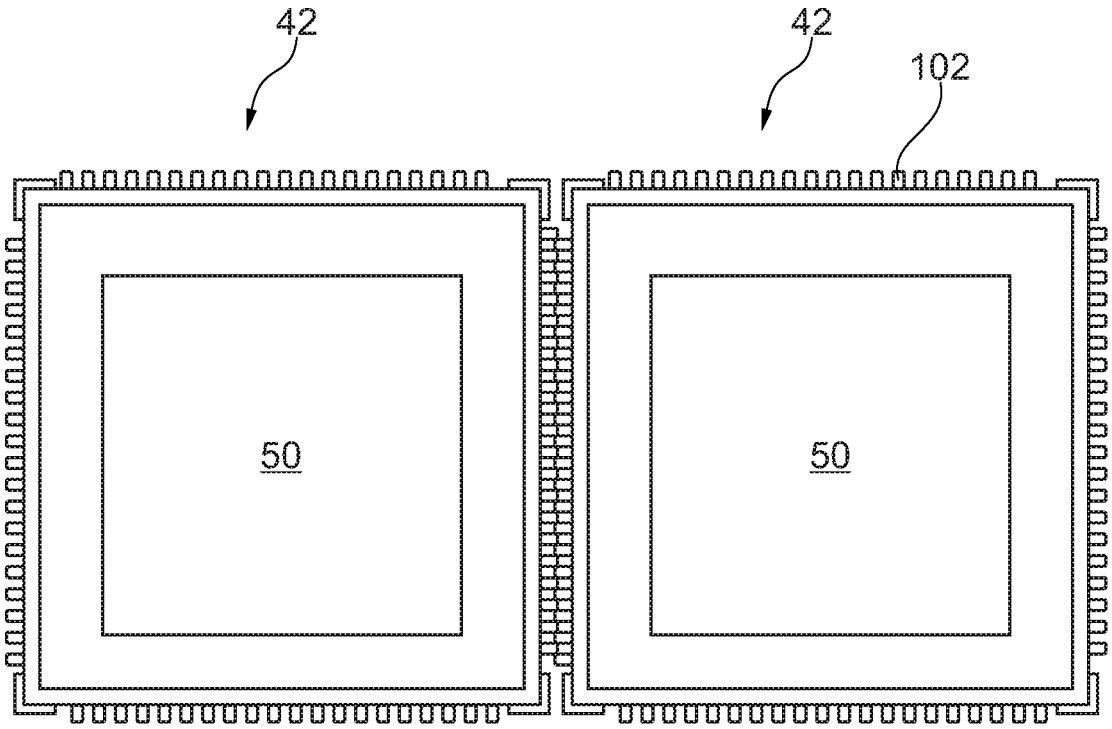
FIG. 24 illustrates in plane view a further embodiment of an auxiliary tool according to the invention.

In FIG. 24 an embodiment comprising frame modules 52 is shown which provides an opening 50 for receiving the air cushion member 6. The frame modules 42 are at their external sides provided with a zipper 102 which provides a coupling together of a number of frame modules thereby to provide a complete frame structure which is able to comprise a wanted number of air cushion members.

Figure 25:
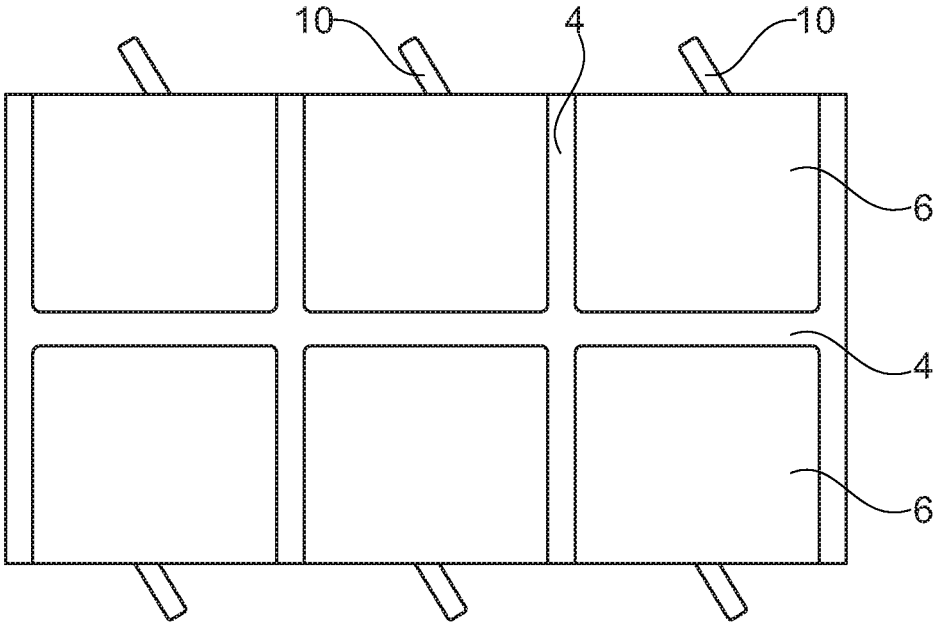
FIG. 25 illustrates in plane view a further embodiment of an auxiliary tool according to the invention.
Figure 26:
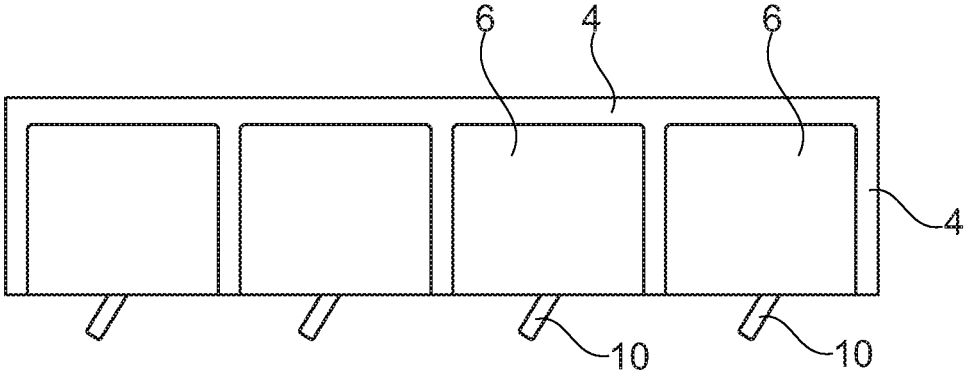
FIG. 26 illustrates in plane view a further embodiment of an auxiliary tool according to the invention.

In FIGS. 25 and 26 a further embodiment is shown where the air cushion members are connected through their edge weldings 4. This provides in principle an auxiliary tool by which the air cushion members are mutually fixed through the edge weldings 4 hereby providing a coherent tool comprising a number of chambers which are inflatable in a selective manner.

Figure 27:
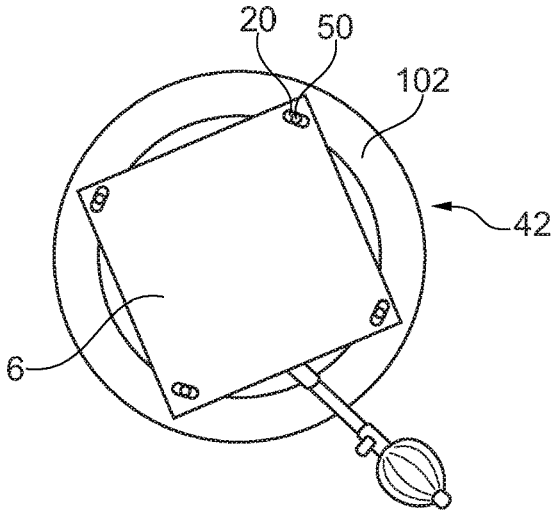
FIGS. 27, 29, 31 illustrate three further embodiments of a module element according to the invention.

In FIG. 27 a frame module 42 is shown within which the frame side portions are provided forming a round shaped frame side portion 102.

Figure 29:
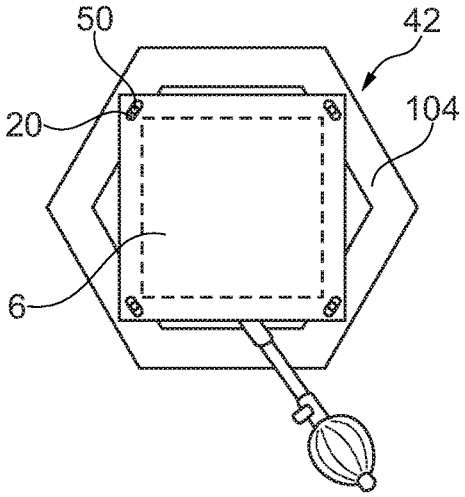

In FIG. 29 a frame module is shown within which the frame side portions are provided forming a hexangular frame side portion 104.

Figure 31:
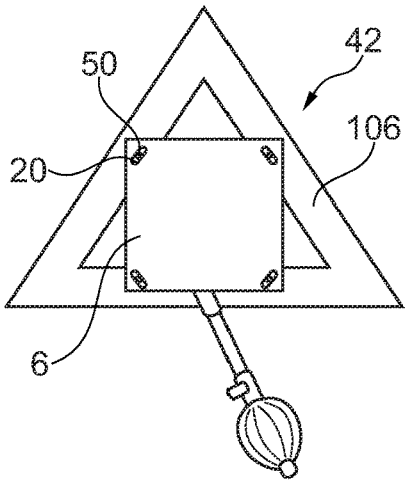

In FIG. 31 a frame module is shown within which the frame side portions are provided forming a triangular frame side portion 106.

Within all the shown embodiments an air cushion member 6 is mounted within the frame module 42 for cooperation between openings 20 and pin members 50. At the embodiments which are shown the coupling together is provided at each of the four corners of the air cushion member.

Figure 28:
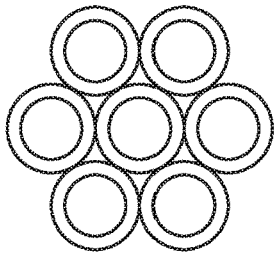
FIGS. 28, 30, 32 illustrate in plane view the structure of an auxiliary tool according to the invention comprising module elements according to FIGS. 27, 29 and 31.
Figure 30:
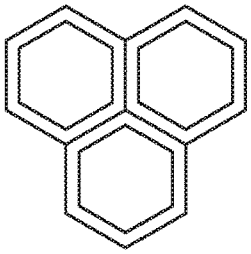
Figure 32:
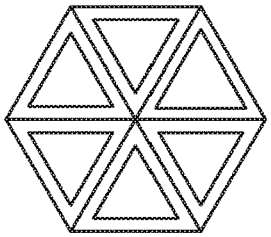

In principle in FIGS. 28, 30 and 32 the fundamental structure of an auxiliary tool is illustrated which is provided by means of the frame modules which are shown in FIGS. 27, 29 and respectively 31.

The mutual fixing of the frame modules 42 may be provided through any suitable joining means. Also hereto may be employed protrusions or recesses. Alternatively at the surface of the frame modules openings for the reception of penetrating pin members may be provided. Also other appropriate joining means may be employed.

Within all the embodiments being shown the air cushion member is shown in shape of a rectangular body. On the other hand, other executions of the air cushion member are also possible.

Figure 33:
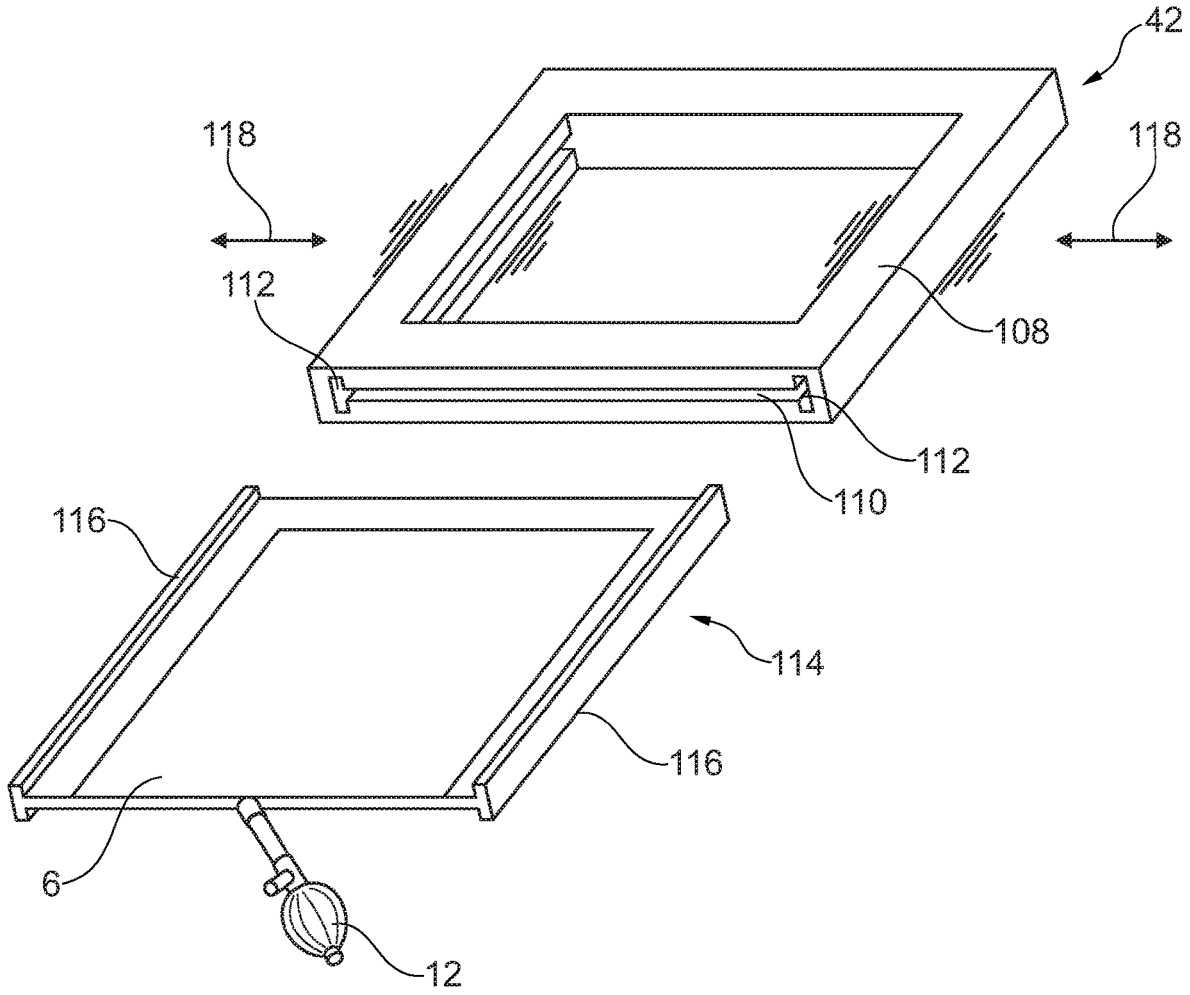
FIG. 33 illustrates in the perspective a further embodiment of a module element of an auxiliary tool according to the invention.

In FIG. 33 a further embodiment of a frame module 42 is shown, whereby a frame portion 108 is provided within which an opening 110 is provided in a frame side member including tracks 112 being provided in the two adjacent frame side portions. Additionally an insertable unit 114 is provided which comprises two rail members 116 which are squeezed in place seated on flanges on the air cushion member 6. The rail members 116 are thus able to be inserted/slided into the tracks 112. The frame side portions are reacting as being flexible, as indicated by means of movement indicating arrows 118, when the air cushion member 6 is pumped.

The invention claimed is:

1. An auxiliary tool for positioning elements in relation to an adjacent flat, whereby the auxiliary tool comprises plural inflatable air cushion members, each air cushion member being made of armored plastic foil in order for the air cushion member to be flexible respectively bendable, but substantially unstretchable, wherein each air cushion member through a hose member is connected to an inflating device as well as a bleeding valve, and whereby each air cushion member is an air-tight bag unit that is flat in a deflated condition and which exhibits layers of the material placed face to face and being joined by welding along free edges for forming bendable protruding reinforced double layer edge flanges and for forming the air tight bag unit, wherein corners of the edge flanges comprise openings; wherein the auxiliary tool further comprises a connecting element for mutual fixation of two or more adjacent air cushion members which selectively are inflatable and which are placed in a side by side relationship with the edge flanges in a common plane, wherein the connecting element comprises only four pin members, wherein a first of the four pin members engages and extends through a first opening, wherein the first opening is in a corner of a flexible protruding edge flange of only a first of the two or more adjacent air cushion members, and wherein a second of the four pin members engages and extends through a second opening, wherein the second opening is in a corner of a flexible protruding edge flange of a second of the two or more adjacent air cushion members for connecting the two flexible protruding edge flanges of adjacent air cushion members by two pin members without overlapping edge flanges, and wherein the connecting element is detachable and separable from the air cushion members, wherein the air cushion members in cooperation with the connecting element are configured for fixating four of the air cushion members to each other by one connecting element in that each one of the four pin members of the one connecting element engages in one opening of a corner of each one of the four adjacent air cushion members.

2. The auxiliary tool according to claim 1, wherein the length of the inflatable air cushion member has the same size as the width of the inflatable air cushion member.

3. The auxiliary tool according to claim 1, wherein the air cushion member is inflatable to achieve a thickness of 50 mm through 60 mm.

4. The auxiliary tool according to claim 1, wherein a third of the four pin members engages a third opening, wherein the third opening is in a corner of a flexible protruding edge flange of a third adjacent air cushion member, and wherein a fourth of the four pin members engages a fourth opening, wherein the fourth opening is in a corner of a flexible protruding edge flange of a fourth adjacent air cushion member.

5. The auxiliary tool according to claim 1, wherein the connecting element has four pin members arranged in four corners of the connecting element in a square relationship.

* * * * *